US010363201B2

(12) United States Patent
Harush

(10) Patent No.: US 10,363,201 B2
(45) Date of Patent: Jul. 30, 2019

(54) BABY BOTTLE APPARATUS WITH FLOW CONTROL

(71) Applicant: Eliezer Elimelech Rose, Bnei Brak (IL)

(72) Inventor: Netanel Shneyor Harush, Yavne (IL)

(73) Assignee: ELIEZER ELIMELECH ROSE, Bnei Brak (IL)

( * ) Notice: Subject to any disclaimer, the term of this patent is extended or adjusted under 35 U.S.C. 154(b) by 34 days.

(21) Appl. No.: 15/663,827

(22) Filed: Jul. 31, 2017

(65) Prior Publication Data

US 2018/0036208 A1 Feb. 8, 2018

(30) Foreign Application Priority Data

Aug. 7, 2016 (IL) ..... 247157

(51) Int. Cl.
*A61J 9/00* (2006.01)
*A61J 11/00* (2006.01)

(52) U.S. Cl.
CPC ..... *A61J 11/002* (2013.01); *A61J 9/006* (2013.01); *A61J 11/0075* (2013.01)

(58) Field of Classification Search
CPC ..... A61J 11/002; A61J 9/006; A61J 11/0075; A61J 9/00
USPC ..... 215/11.1, 11.4, 11.5; 222/399
IPC ..... A61J 11/002,11/00
See application file for complete search history.

(56) References Cited

U.S. PATENT DOCUMENTS 2,039,373 A * 5/1936 Wittmann ..... A61J 11/002 446/180
2001/0027956 A1* 10/2001 Bonacorso ..... A61J 9/00 215/11.1
2002/0066741 A1 6/2002 Rees
2004/0188372 A1* 9/2004 Ruth ..... A61J 9/00 215/11.4
2008/0035596 A1* 2/2008 Frisch ..... A61J 9/00 215/6
2008/0302711 A1* 12/2008 Windmiller ..... B65D 1/06 210/137
2014/0102918 A1* 4/2014 Eitrheim ..... A61J 9/00 206/219

FOREIGN PATENT DOCUMENTS

WO 0048491 A1 8/2000

OTHER PUBLICATIONS

Extended European Search Report (EESR) dated Jan. 31, 2018 issued in counterpart European Application No. 17184997.9.

* cited by examiner

*Primary Examiner* — Fenn C Mathew
*Assistant Examiner* — Cynthia F Collado
(74) *Attorney, Agent, or Firm* — Holtz, Holtz & Volek PC

(57) ABSTRACT

In one aspect, the present invention is directed to a baby bottle apparatus, comprising: a nipple (11); a liquid container (12); a flexible tube (17) connecting the nipple to the container; a normally-closed valve, for controlling the flow of fluid from the container (12) to the nipple (11); at least one lever (13), for opening the valve for fluid passage from the container to the nipple; thereby allowing a user to control fluid flow from the baby bottle apparatus. Preferably, the mechanism for limiting the distance between the parallel bars comprising a rotatable ring (15) having a different outer diameter therealong, such that a movement of each of the levers (13) is limited by the ring (15).

11 Claims, 10 Drawing Sheets

BABY BOTTLE APPARATUS WITH FLOW CONTROL

TECHNICAL FIELD

The present invention relates to the field of baby bottles.

BACKGROUND ART

Currently, baby bottles are well known. A baby bottle apparatus usually comprises a container and a ring with a nipple screwed therein. In order to feed a baby, the user (generally, a parent) turns the bottle apparatus diagonally, and lets the liquid flow out of the bottle apparatus through the nipple. In order to stop the feeding, the user must change the angle of the bottle apparatus, or remove it from the baby's mouth. In both cases, it is awkward and inconvenient.

It is an object of the present invention to provide a solution to the above-mentioned and other problems of the prior art.

Other objects and advantages of the invention will become apparent as the description proceeds.

SUMMARY OF THE INVENTION

In one aspect, the present invention is directed to a baby bottle apparatus, comprising:

- a nipple (11);
- a liquid container (12);
- a flexible tube (17) connecting the nipple to the container;
- a normally-closed valve, for controlling the flow of fluid from the container (12) to the nipple (11);
- at least one lever (13), for opening the valve for fluid passage from the container to the nipple;
- thereby allowing a user to control fluid flow from the baby bottle apparatus.

According to one embodiment of the invention, the valve comprises:

- two parallel bars (22), at least one connected to one of the levers (13); and
- means for pulling or pushing the parallel bar (22) towards the other;
- wherein the flexible tube (17) is disposed between the bars (22);
- thereby resulting in a normally-closed state valve for opening and closing the valve.

According to one embodiment of the invention, the means for pulling or pushing the parallel bar (22) towards the other (for generating the closed state of the apparatus) is one or more rubber bands.

According to another embodiment of the invention, the means for pulling or pushing the parallel bar (22) towards the other (for generating the closed state of the apparatus) is one or more springs.

Preferably, each of the levers (13) is in the form of a handle connected to the baby bottle apparatus by a hinge (14).

Preferably, the outline of each of the levers (13) is parallel to the outline of the container, in order to allow a user to use the same hand for holding the container while pressing the handles, wherein the distance between the outline of the container and the outline of each handle is up to 1 cm.

Preferably, the baby bottle apparatus further comprises a base (18) to which each of the hinges (14) is connected, wherein the base is connected to the container by a connection (such as a threaded connection or snap connection), the base having a bore (23) in a center thereof through which the flexible tube (17) passes.

Preferably, the baby bottle apparatus further comprises a mechanism for limiting the distance between the parallel bars (22).

Preferably, the mechanism for limiting the distance between the parallel bars comprising a rotatable ring (15) having a different outer diameter therealong, such that a movement of each of the levers (13) is limited by the ring (15).

The baby bottle apparatus may further comprise a canopy (16), for protecting the face of a baby using the bottle apparatus from inner parts of the valve.

In another aspect, the present invention is directed to a baby bottle apparatus, comprising:

- a flexible tube (17) connecting a nipple (11) of said baby bottle apparatus to a fluid container (12) of said baby bottle apparatus;
- a mechanism employing one or more levers (13) for squeezing/releasing said flexible tube (17) thereby disabling/enabling fluid flow through said tube (17) upon pressing/releasing said levers (13); and
- a mechanism for keeping said flexible tube squeezed until released by said levers.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Preferred embodiments, features, aspects and advantages of the present invention are described herein in conjunction with the following drawings.

Each of FIGS. 1*a* and 1*b* schematically illustrates a baby bottle apparatus, according to one embodiment of the invention.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

Figure 1A:
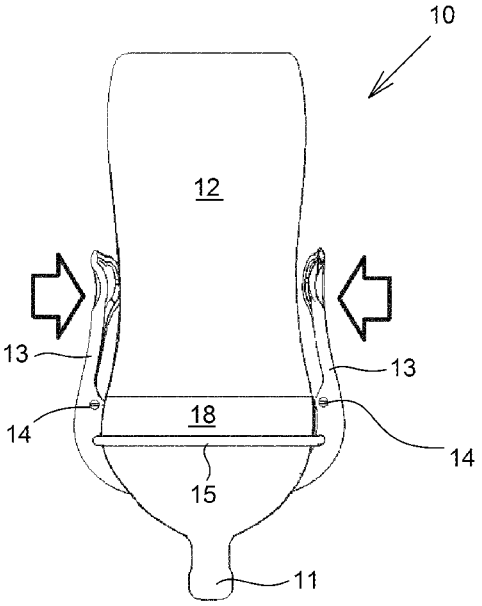
Figure 1B:
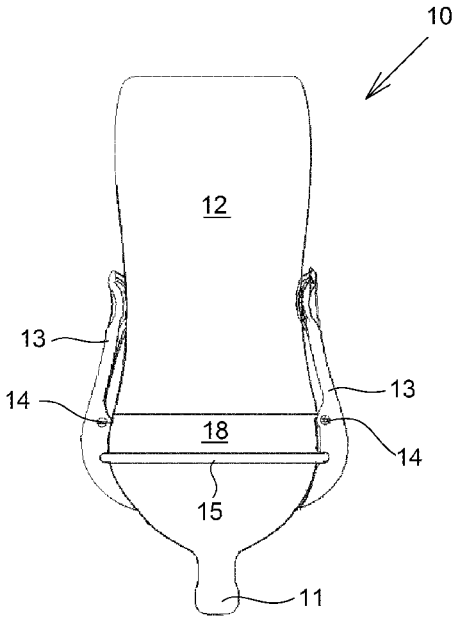

Each of FIGS. 1*a* and 1*b* schematically illustrates a baby bottle apparatus, according to one embodiment of the invention.

As illustrated, the baby bottle apparatus, which is marked herein by reference numeral 10, comprises a nipple 11, a container 12, two levers 13, each rotating around a hinge 14.

When a parent presses the levers 13, a valve (not illustrated in these figures) controllable by the levers 13 opens, and allows fluid from the container (not illustrated) to pour out of the container 12 through the nipple 11.

Also seen in these figures is an adjustment-ring 15, upon which the user can set the maximum hole size (the hole is not illustrated in this figure), which determines the liquid flow rate.

The valve is normally closed. While FIG. 1*a* illustrates the baby bottle apparatus in its idle state, i.e., when the valve is closed, FIG. 1*b* illustrates the bottle apparatus in its active state, i.e., the valve is open and fluid can pour out of the container. In this situation the levers touch the container, which blocks their rotation.

The arrows in FIG. 1*a* illustrated the direction to which the parent has to press the lever with his fingers.

Figure 2:
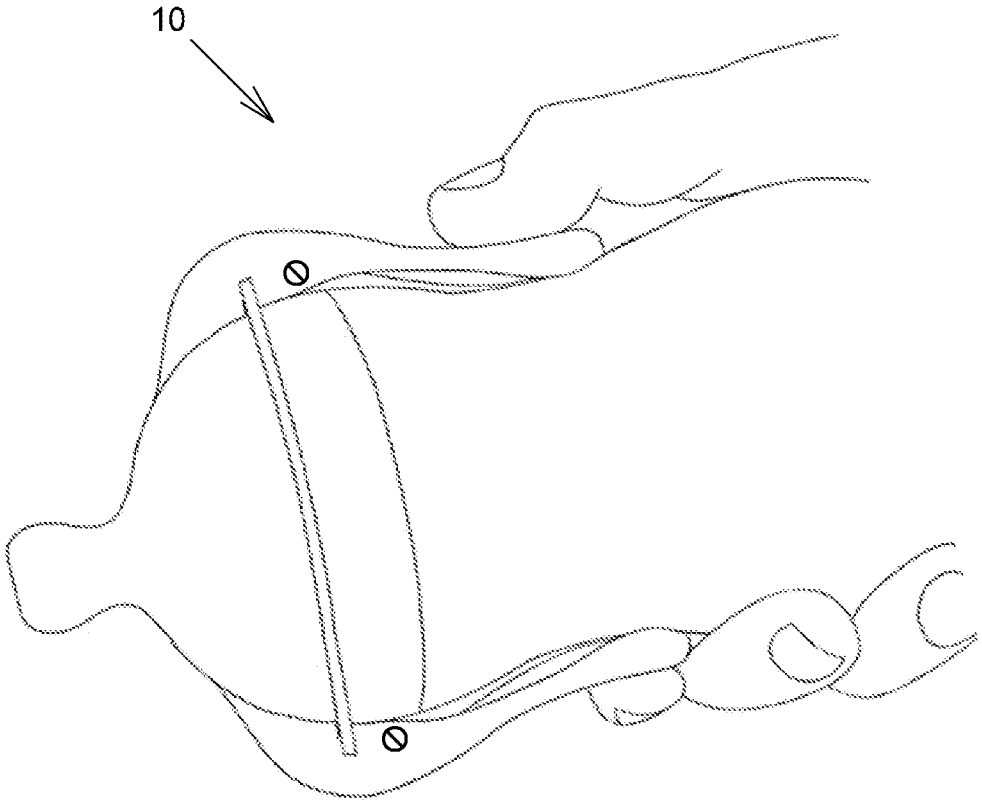
FIG. 2 pictorially illustrates the baby bottle apparatus of FIG. 1, in a feeding operation. As illustrated, the user applies pressure on levers 13 against the walls of container 12.

FIG. 2 pictorially illustrates the baby bottle apparatus of FIG. 1, in a feeding operation. As illustrated, the user applies pressure on levers 13 against the walls of container 12.

Figure 3A:
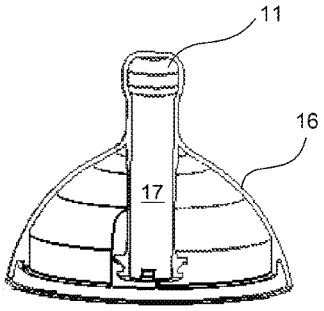
FIG. 3*a* is a sectioned view on a nipple assembly of the baby feeding of FIG. 1.
Figure 3B:
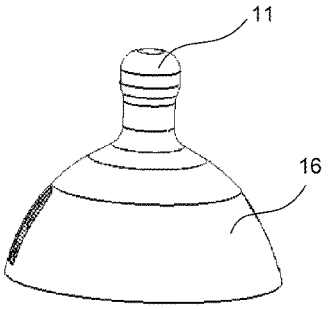
FIG. 3*b* is a front view thereof.
Figure 3C:
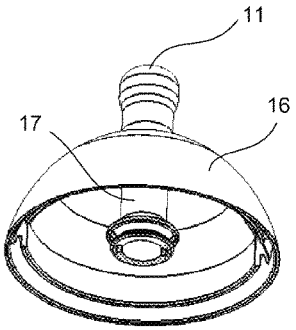
FIG. 3*c* is a perspective bottom view thereof.

FIG. 3*a* is a sectioned view on a nipple assembly of the baby feeding of FIG. 1. FIG. 3*b* is a front view thereof. And FIG. 3*c* is a perspective bottom view thereof.

The nipple assembly comprises nipple 11, canopy 16 and a tube 17 in continuation with nipple 11. The tube connects the nipple to the container, i.e., the liquid passage from the container passes through the flexible tube 17.

As will be explained and illustrated, the tube 17 is a part of the valve.

Figure 4A:
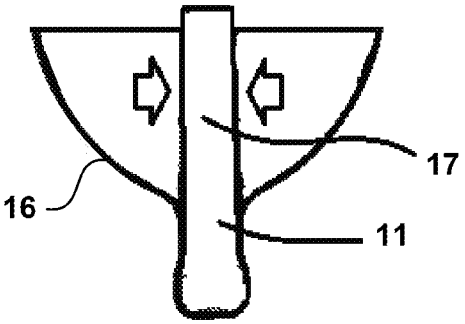
FIG. 4*a* is a sectional view of the nipple assembly of FIG. 2 when the bottle apparatus thereof is in its active state (i.e., open state).

FIG. 4*a* is a sectional view of the nipple assembly of FIG. 2 when the bottle apparatus thereof is in its active state (i.e., open state).

Figure 4B:
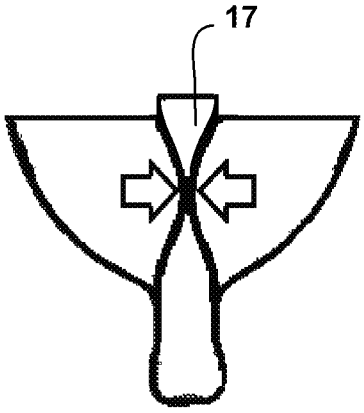
FIG. 4*b* is a sectional view of the nipple assembly of FIG. 2 when the bottle apparatus thereof is in its idle state (i.e., closed state).

FIG. 4*b* is a sectional view of the nipple assembly of FIG. 2 when the bottle apparatus thereof is in its idle state (i.e., closed state).

The arrows illustrate the direction in which the flexible tube 17 is pressed in order to close fluid passage through the flexible tube 17. The pressing mechanism is described and illustrated hereinafter.

Figure 5:
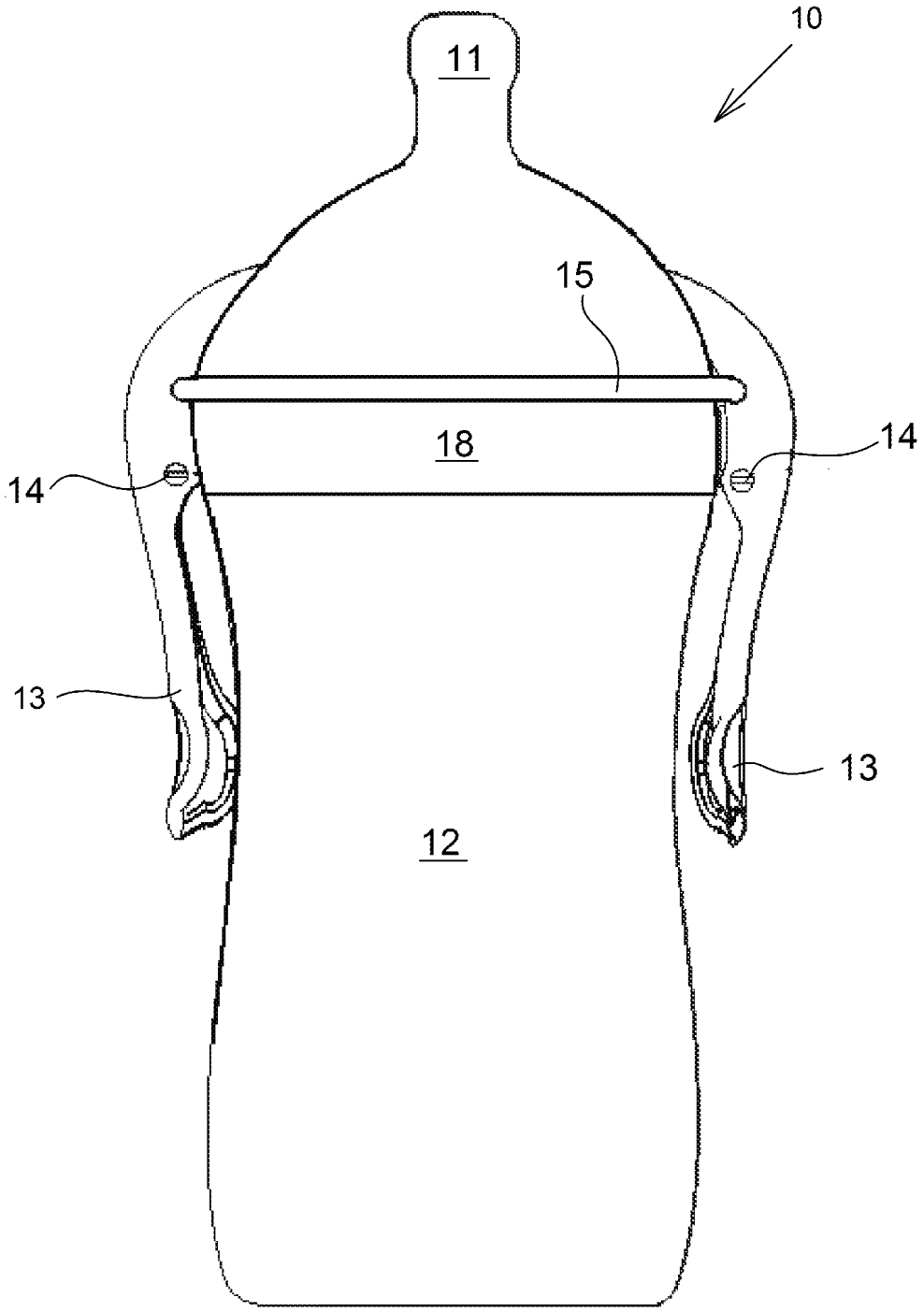
FIG. 5 is a front view of FIG. 1.

FIG. 5 is a front view of FIG. 1. Attention is drawn to base 18, which is used as a chassis. The following elements are connected to the base 18: The nipple assembly, the container 12 which is threaded to base 18, and adjustment-ring 15 which adjusts the rate of passing fluid, as will be described and illustrated hereinafter.

Figure 6A:
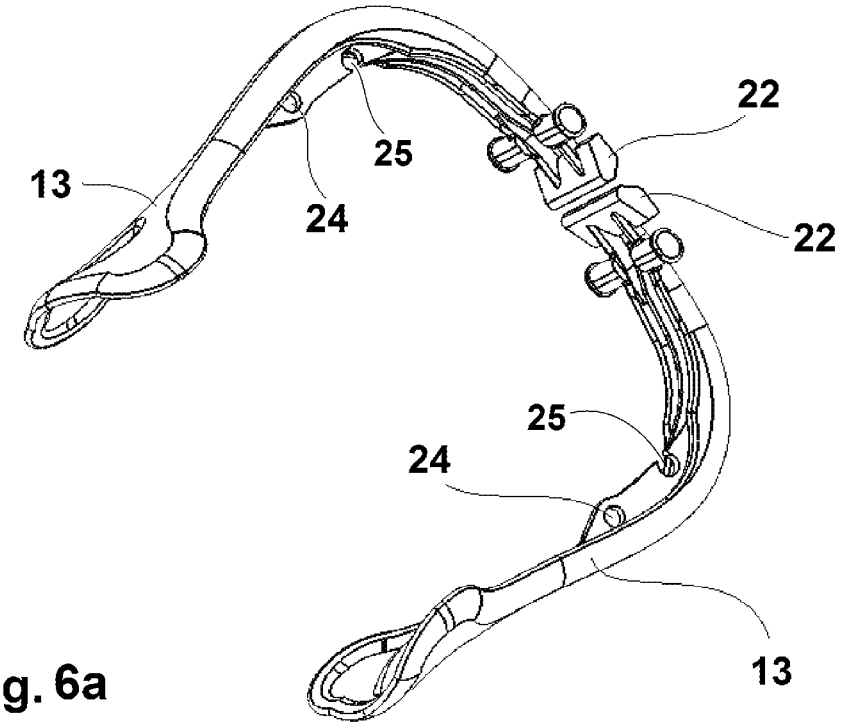
FIG. 6*a* is a bottom perspective view on the mechanism that applies pressure on the tube (not visible in this drawing).

FIG. 6*a* is a bottom perspective view on the mechanism that applies pressure on the tube (not visible in this drawing).

Figure 6B:
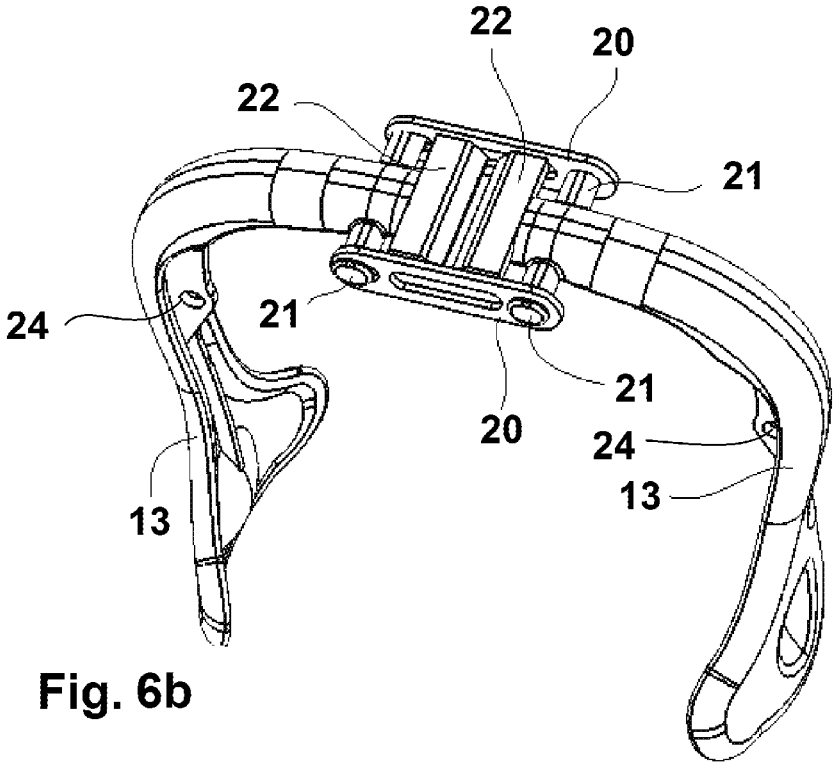
FIG. 6*b* is a top perspective view on the mechanism that applies pressure on the tube (not visible in this drawing).

FIG. 6*b* is a top perspective view on the mechanism that applies pressure on the tube (not visible in this drawing).

Each of the levers 13 ends with a pressing-bar 22. The tube (not shown but marked in other figures as reference numeral 17) that connects the nipple to the container is not shown in this figure.

Elements 20 are rubber bands (shown only in FIG. 6*b*) that are anchored to shafts 21. The rubber bands 20 apply pulling force on the arms that include the pressing-bars 22, and as a result they are pulled to each other. Thus, in the idle state, i.e., when the user does not apply force on the levers 13, the pressing-bars 22 are pulled to each other, thereby blocking liquid passage through the squeezed tube (17 in other figures).

It should be noted that each of the levers has a bore 24 through which the lever axis (not shown in this figure but marked in other figures by reference numeral 14) passes through. When the user presses the levers against the container 12 (not shown in these figures) the handles rotate around bore 24 into which hinge 14 is disposed, thereby opening a gap between the pressing-bars 22, thereby allowing liquid to pass through the tube.

It should be noted that each of the pressing-bars 22 has a straight edge that turns towards the straight edge of the other pressing-bar. Of course, the pressing-bars do not have to be "too" sharp, in order not to cut the flexible tube 17 (not shown in these figures).

Figure 7:
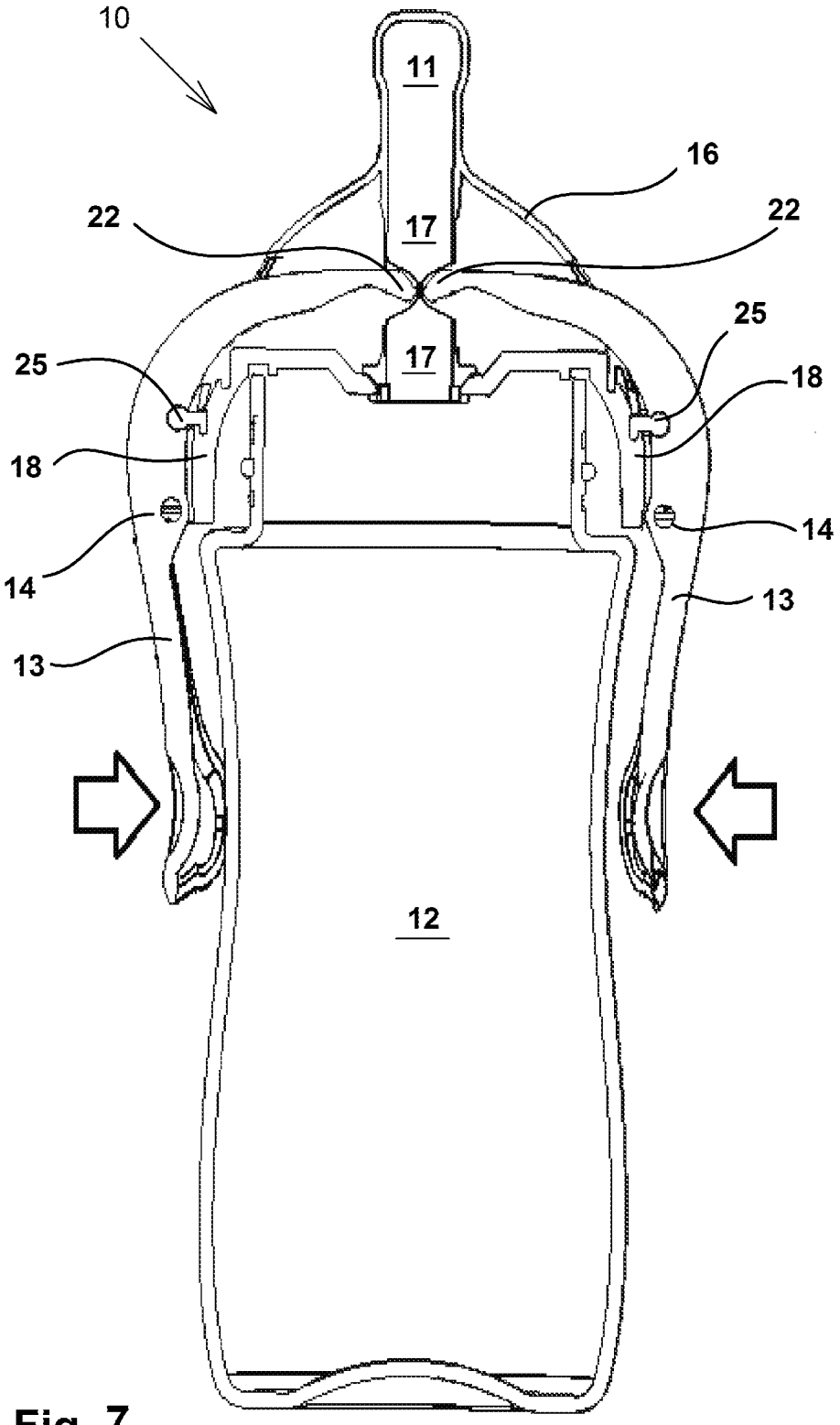
FIG. 7 is a sectional view of the baby bottle apparatus of FIG. 1 in an idle state.

FIG. 7 is a sectional view of the baby bottle apparatus of FIG. 1 in an idle state.

The baby bottle apparatus comprises a container 12 for storing therein baby food in a liquid state of aggregation. The levers 13 rotate around hinge 14. The rotation is limited, as will be detailed hereinafter.

In the idle state illustrated in this figure, pressing-bars 22 are pushed against each other, thereby blocking liquid passage therethrough. Upon pressing the levers 13 towards the walls of container 12, levers 13 rotate along hinge 14, thereby drawing the pressing-bars 22 away from each other, thereby allowing liquid passage through the flexible tube 17.

It should be noted that nipple 11 connects to the container 12 through flexible tube 17. Base 18 connects to the container 12 via a snap connector. Flexible tube 17 enters into base 12.

Figure 8A:
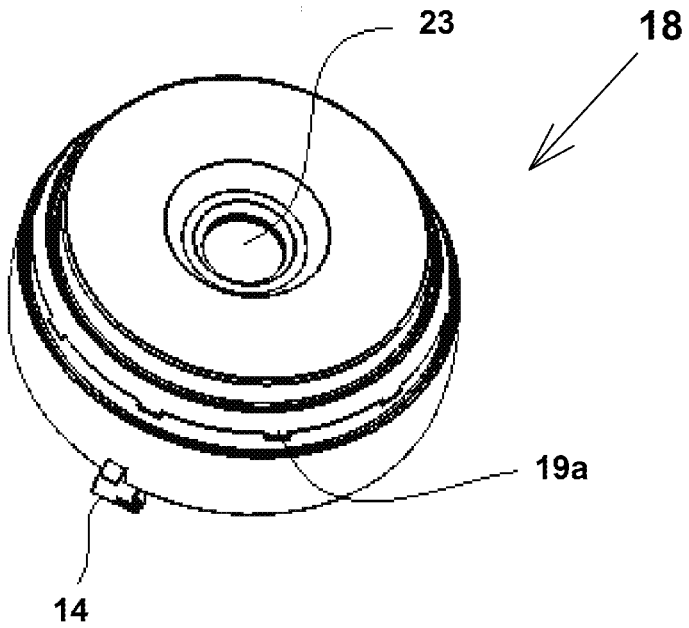
FIG. 8*a* is a perspective view of the base 18 of the baby bottle apparatus of FIG. 1.
Figure 8B:
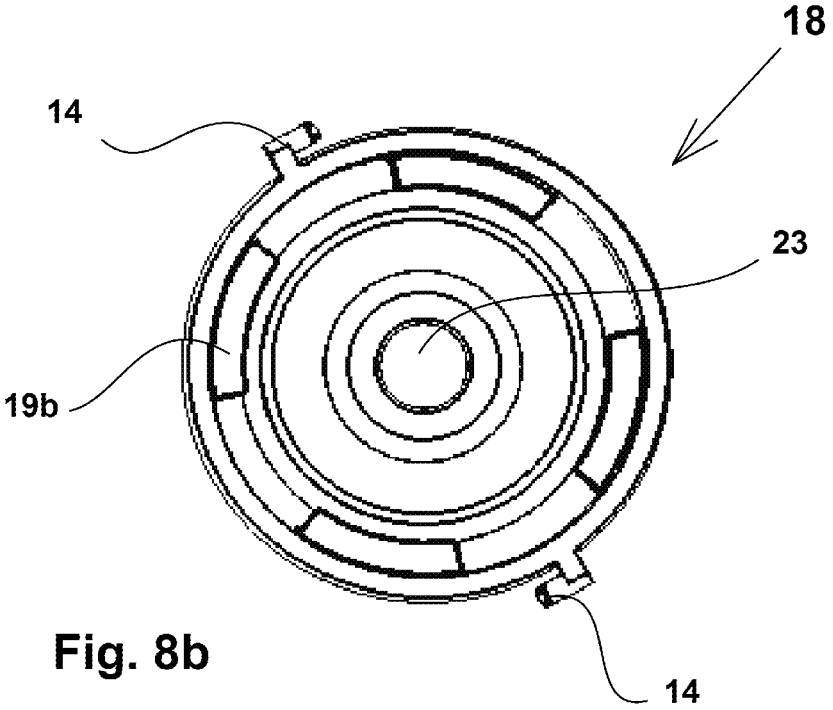
FIG. 8*b* is a top view thereof.

FIG. 8*a* is a perspective view of the base 18 of the baby bottle apparatus of FIG. 1, and FIG. 8*b* is a top view thereof.

The figures show the bore 23 through which flexible tube 17 passes.

Also shown is a snap connector which comprises parts 19*a* and 19*b*, for connecting base 18 to the container 12.

The figures also demonstrate the way each of the hinges 14 is connected to base 18.

Figure 9A:
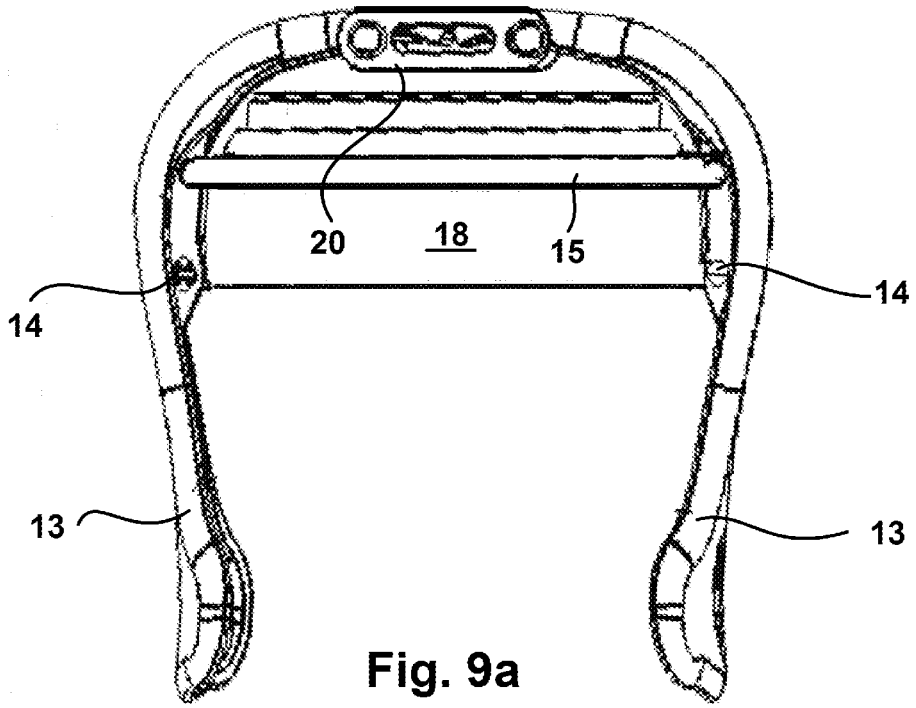
FIGS. 9*a* to 9*b* illustrate a mechanism for adjusting the maximum gap between the pressing-bars 22, according to one embodiment of the invention.
Figure 9B:
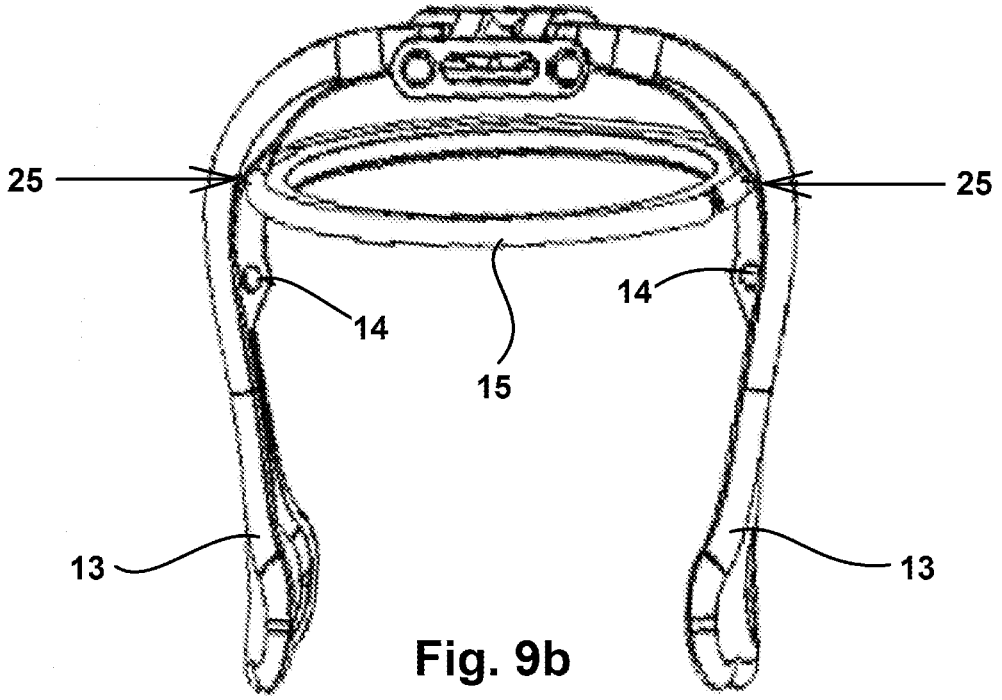

FIGS. 9*a* to 9*b* illustrate a mechanism for adjusting the maximum gap between the pressing-bars 22, according to one embodiment of the invention. FIG. 9*a* is a front view of this mechanism, and FIG. 9*b* is a perspective bottom view thereof.

As described above, opening a gap between the pressing-bars 22 is carried out by pressing on levers 13 against the walls of the container 12. The movement of the levers against the container's walls is limited. The maximum gap between the pressing-bars 22 happens in the situation where the levers touch the walls of the container.

Adjustment-ring 15 is used as means for adjusting the maximum gap between the pressing-bars 22. The adjustment ring rotates around base 18 (not illustrated in these figures).

Figure 10A:
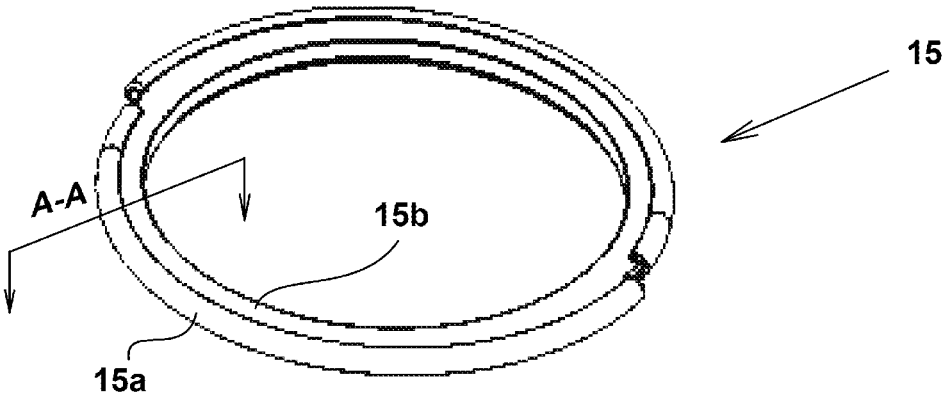
FIGS. 10*a*, 10*b* and 10*c* illustrate the structure and operation of adjustment-ring 15, of FIGS. 9*a* and 9*b*.
Figure 10B:
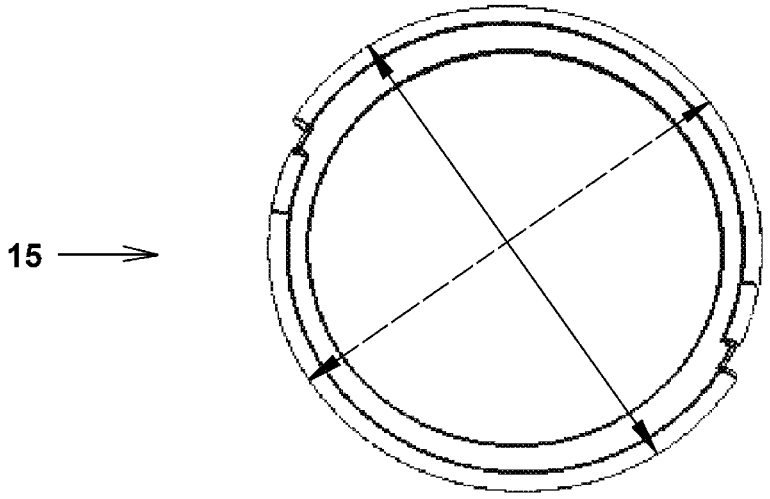
Figure 10C:
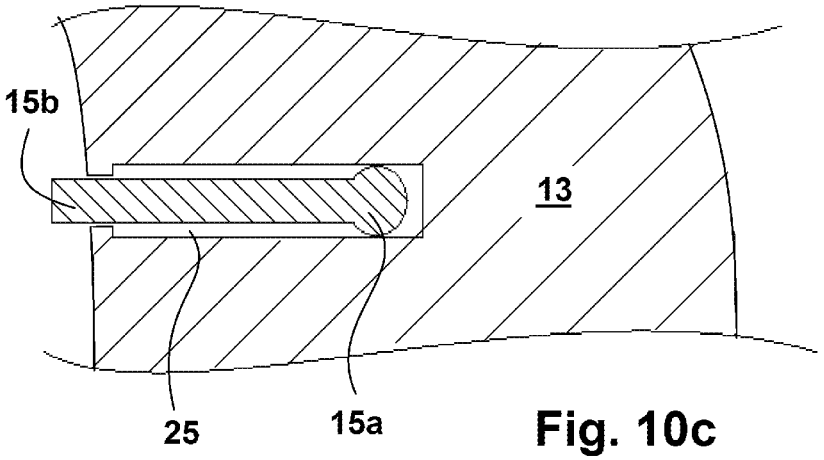

FIGS. 10*a*, 10*b* and 10*c* illustrate the structure and operation of adjustment-ring 15, of FIGS. 9*a* and 9*b*.

FIG. 10*a* is a perspective view of the adjustment-ring 15. A cross-section A-A is defined in the figure.

FIG. 10*b* is a top view thereof. Two arrows point on the diameter of the adjustment-ring, a solid arrow and a dashed arrow. The diameter of the solid arrow is greater than the diameter of the dashed arrow. The inner diameter is the same.

FIG. 10*c* is the section A-A defined in FIG. 10*a*.

Reference numeral 15*a* is a "head" of adjustment-ring 15, and reference numeral 15*b* is a "tail" of the adjustment-ring. The "head" 15*a* is disposed into bore 25 in levers 13. The opening of bore 15 is narrower than the "head" 15*a*, and therefore the movement of lever 13 towards the walls of the container is limited by the adjustment-ring 15.

Since the diameter of the adjustment-ring 15 is not constant as illustrated in FIG. 10*b* and the description thereof, the maximum closing movement of the levers 13 is limited by the adjustment-ring 15.

Thus, by changing the rotation angle of the adjustment-ring 15 a user (parent) can adjust the maximum gap generated between the pressing bars 22 (not illustrated in these figures), and thereby to adjust the fluid flow rate of the feeding bottle apparatus.

In the figures and/or description herein, the following reference numerals (Reference Signs List) have been mentioned:

numeral 10 denotes a baby bottle apparatus, according to one embodiment of the invention;
numeral 11 denotes a nipple thereof,
numeral 12 denotes a container thereof,
numeral 13 denotes a lever;
numeral 14 denotes a hinge along which levers 13 rotate;
numeral 15 denotes an adjustment-ring;
numeral 16 denotes a canopy;
numeral 17 denotes a flexible tube;
numeral 18 denotes a base;
each of numerals 19*a* and 19*b* denotes a part of a snap connector;
numeral 20 denotes a rubber band;
numeral 21 denotes an anchor for the rubber band;
numeral 22 denotes a pressing bar;
numeral 23 denotes a bore in the center of base 18, through which flexible tube 17 passes;
numeral 24 denotes a hinge's bore; and
numeral 25 denotes an aperture in lever 13 for adjustment-ring 15.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

The invention claimed is:

1. A baby bottle apparatus, comprising:
a nipple;
a liquid container;
a flexible tube connecting said nipple to said container;
a normally-closed valve, for controlling fluid flow from said container to said nipple;
at least one lever, for opening said valve for fluid passage from said container to said nipple, thereby allowing a user to control fluid flow from said baby bottle apparatus,
wherein said valve comprises:
two parallel bars, at least one of said parallel bars being connected to one of said at least one lever; and
at least one elastic member, for pulling or pushing one of said parallel bars toward the other, and
wherein said flexible tube is disposed between said parallel bars, thereby resulting in said normally-closed state valve.

2. The baby bottle apparatus according to claim 1, wherein said at least one elastic member comprises at least one rubber band.

3. The baby bottle apparatus according to claim 1, wherein said at least one elastic member comprises at least one spring.

4. The baby bottle apparatus according to claim 1, wherein each of said at least one lever comprises a handle connected to said baby bottle apparatus by a hinge.

5. The baby bottle apparatus according to claim 4, wherein an outline of each of said at least one lever is parallel to an outline of said container, in order to allow a user to use one hand to hold said container while pressing the handles, and
wherein a distance between the outline of the container and the outline of each of the handles is up to 1 cm.

6. The baby bottle apparatus according to claim 4, further comprising a base to which each of said hinges is connected,
wherein said base is connected to said container by a connection, said base having a bore in a center thereof through which said flexible tube passes.

7. The baby bottle apparatus according to claim 6, wherein said connection comprises a thread.

8. The baby bottle apparatus according to claim 6, wherein said connection comprises a snap connector.

9. The baby bottle apparatus according to claim 1, further comprising a mechanism for limiting a distance between said parallel bars.

10. The baby bottle apparatus according to claim 9, wherein said mechanism comprises a rotatable ring having a variable outer diameter, a movement of each of said at least one lever being limited by said ring.

11. The baby bottle apparatus according to claim 1, further comprising a canopy, for protecting a face of a baby using said bottle apparatus from inner parts of said valve.

* * * * *